US006081677A

United States Patent [19]

Maess et al.

[11] Patent Number: 6,081,677

[45] Date of Patent: Jun. 27, 2000

[54] PROCESS FOR OPTIMIZING A HALF-TONE REPRODUCTION ON A PHOTOCONDUCTOR OF ELECTROPHOTOGRAPHIC PRINTERS AND COPIERS

[75] Inventors: Volkhard Maess, Erding; Martin Schleusener, Zorneding, both of Germany

[73] Assignee: Océ Printing Systems GmbH, Poing, Germany

[21] Appl. No.: 09/230,898

[22] PCT Filed: Jul. 2, 1987

[86] PCT No.: PCT/DE97/01405

§ 371 Date: Jun. 1, 1999

§ 102(e) Date: Jun. 1, 1999

[87] PCT Pub. No.: WO98/06011

PCT Pub. Date: Feb. 12, 1998

[30] Foreign Application Priority Data

Aug. 2, 1996 [DE] Germany ..... 196 31 378

[51] Int. Cl.[7] ..... G03G 15/00

[52] U.S. Cl. ..... 399/49; 399/72

[58] Field of Search ..... 358/406, 458, 358/504, 519, 521; 399/49, 50, 51, 53, 72

[56] References Cited

U.S. PATENT DOCUMENTS

| | | | |
|---|---|---|---|
| 4,949,105 | 8/1990 | Prowak . | |
| 4,999,673 | 3/1991 | Bares . | |
| 5,400,120 | 3/1995 | Narazaki et al. . | |
| 5,566,372 | 10/1996 | Ikeda et al. . | |
| 5,572,330 | 11/1996 | Sasanuma | 358/298 |
| 5,737,665 | 4/1998 | Sugiyama et al. | 399/39 |
| 5,808,651 | 9/1998 | Horiuchi | 399/46 |
| 5,887,223 | 11/1996 | Sakai et al. | 399/60 |

FOREIGN PATENT DOCUMENTS

| | | |
|---|---|---|
| 0 542 502 A2 | 5/1993 | European Pat. Off. . |
| 33 40 529 | 5/1984 | Germany . |
| 34 32 515 | 3/1985 | Germany . |
| 38 43 672 | 7/1989 | Germany . |
| 38 07 121 | 9/1989 | Germany . |

*Primary Examiner*—Arthur T. Grimley
*Assistant Examiner*—Hoang Ngo
*Attorney, Agent, or Firm*—Hill & Simpson

[57] ABSTRACT

A printer or copier optimizes half tone printing by a method including printing a raster toner mark and scanning the raster toner mark to determine if it is in the parameters for optimum half-tone reproduction. The raster toner mark has pixels with toner and pixels without toner. If the optical density of the raster toner mark is below a lower limit, the bias voltage between the photoconductor and the developer station is increased so long as the current bias voltage is below an upper limit. The optical density may also be increased by increasing the ratio of toner mixed into the carrier particles. If the raster toner mark is above the target optical density, the bias voltage is decreased (if it is above a minimum level) and/or the ratio of toner to carrier particles is decreased. The combined effects of adjusting toner/carrier ratio (a slower process) with adjusting the bias voltage (a faster process) provides optimization of the half-tone printing.

14 Claims, 3 Drawing Sheets

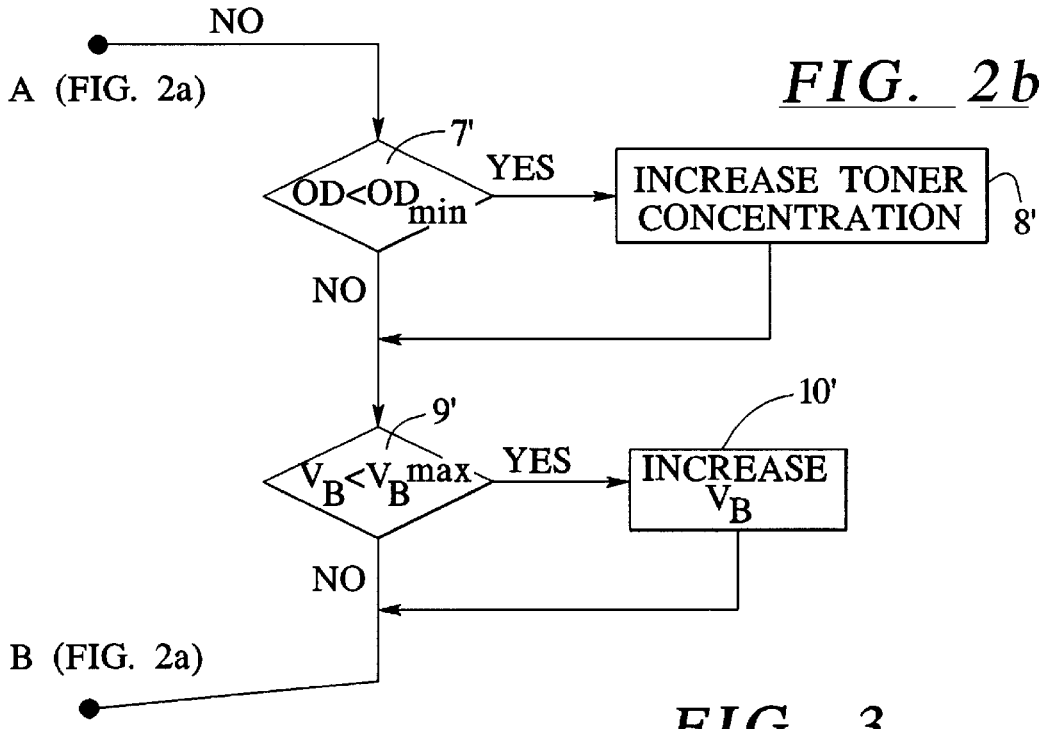
FIG. 2b
FIG. 3
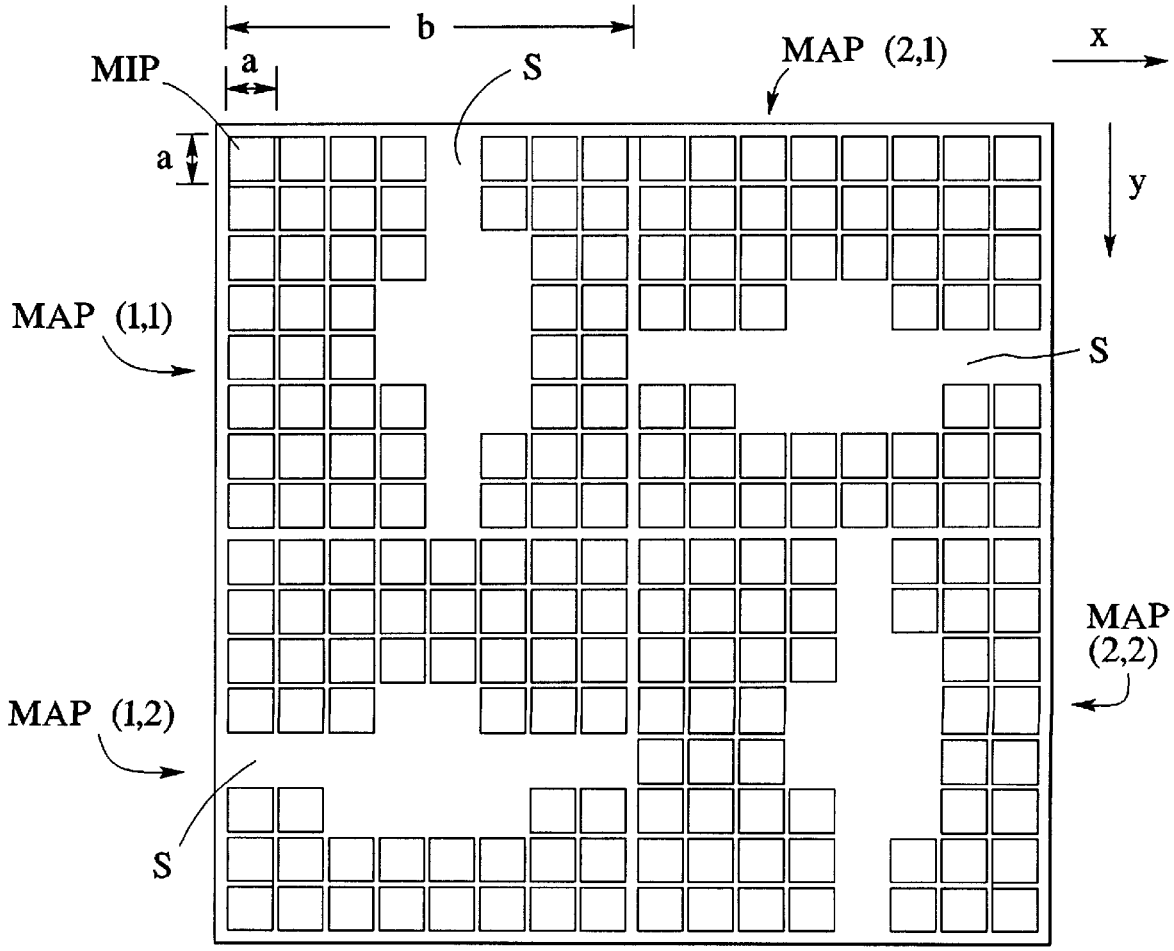

PROCESS FOR OPTIMIZING A HALF-TONE REPRODUCTION ON A PHOTOCONDUCTOR OF ELECTROPHOTOGRAPHIC PRINTERS AND COPIERS

BACKGROUND OF THE INVENTION

1. Field of the Invention

Method for optimizing a half-tone representation on a photoconductor of electrophotographic printer and copier apparatuses The present invention relates to a method for optimizing a half-tone representation by optimization of the toner application intensity on a photoconductor of electrophotographic printer and copier apparatuses.

2. Description of the Related Art

Users make extremely high quality demands of printouts and copies produced by means of electrophotographic printer or, respectively, copier apparatuses. In order to meet these high demands, it is necessary to reduce the ranges of tolerance permissible in electrophotographic processes.

For example, in electrophotographic printer and copier apparatuses individual pages or endless strips of paper are printed by producing a latent image on a photoconductor, preferably fashioned as a drum. For this purpose, a photoconductor is charged to a defined charge potential, and subsequently, dependent on the method used, the regions that appear white or black in the printout are exposed. The exposed regions then comprise a discharge potential that is lower in relation to the charge potential. The produced latent image is then developed by applying toner to the exposed or unexposed regions, dependent on the method used, so that these regions appear black in the printout.

The toner standardly used is preferably a two-component toner consisting of a carrier component and microtoner. In turn, the two-component toner is charged positive or negative dependent on the method used.

The image developed on the photoconductor is subsequently transferred onto paper or onto another recording medium, and, in a fixing station, is subsequently melted into the recording medium by heating, or is bonded therewith by means of adhesive forces that arise during the melting of the toner image.

After the transfer of the image from the photoconductor onto the recording medium, the photoconductor is cleaned and fully discharged, in preparation for the production of the next image.

The differences in density of different printouts, caused by fluctuations of the process parameters of printer and copier apparatuses, become particularly clear when a large number of identical images are produced in succession. If these images are for example images with gray surfaces, comprising a fine gray value gradation, even small fluctuations in the gray value are perceived by the human eye.

Such fluctuations can for example be caused by process parameters such as the charge potential to which the photoconductor is charged at the beginning of each print process, by the discharge potential attained by certain regions of the photoconductor after the exposure, and by fluctuations in the intensity of exposure. The charge and/or discharge potential of the photoconductor can be dependent in particular on the producing charge, the duration of use, the temperature and the cyclical loading of the photoconductor.

A toner deposit intensity, i.e. the quantity of toner deposited in a region to be inked on the photoconductor, is essentially dependent on the air humidity and the toner concentration in the two-component toner, i.e. the mixing ratio between the microtoner and the carrier components. In addition, the toner deposit intensity is dependent on the triboelectric state of excitation of the two-component toner, which is for example in turn dependent on the temperature, the air humidity, the duration of use, the intensity and the duration of the thorough mixing of the two-component toner, as well as on the quantity of fresh toner supplied to the mixer.

For limiting the above-described parameter fluctuations in electrophotographic processes, it is known to keep the photoconductor temperature constant, to regulate the charge potential of the photoconductor, to regulate the discharge depth, i.e. the difference between the charge and discharge potential of the photoconductor, to keep constant the exposure energy for the production of the discharge potential, to regulate the toner concentration in the two-component developer or for example to carry out a toner mark regulation. Toner marks are here understood as regions that are arranged outside the print image on the photoconductor and are exposed and developed for process monitoring and control.

The above-described regulations for the reduction of the parameter fluctuations are carried out either individually or in combinations. Individually, the above regulation methods effect only a partial stabilization, which is however not sufficient for the high demands made with respect to the required print quality, in particular given a half-tone representation.

From the German Published Patent application DE-A1-38 43 672, a method is known for optimizing a toner deposition intensity in copier apparatuses that operate in analog fashion, in which method, dependent on an optical density of a toner mark, a bias potential and/or a toner concentration is modified. As a toner mark, an unrastered "image pattern" with full-surface inking is used.

Due to the use of a toner mark with full-surface inking, in connection with the analog functioning of the copier apparatus, this regulation is not suitable for the optimization of a half-tone image.

If, in contrast, a coarsely gridded toner mark is used that comprises, in contrast to the full-surface toner mark, both inked and non-inked regions, a stable regulation of the toner deposition intensity can be achieved only if high-ohmic two-component developers are used. Since high-ohmic two-component developers cannot be used with modern conductive developer brushes, this method cannot be used in modern printer or copier apparatuses.

In addition, for the regulation of the electrophotographic process in electrophotographic apparatuses, it is generally known to scan raster toner marks with the aid of sensors, and to control process parameters dependent on the optical density thereof. Thus, in U.S. Pat. No. 4,999,673 the integral density of a toner mark is determined via a densitometer, and the toner concentration or another process parameter is modified accordingly. In U.S. Pat. No. 4,949,105, toner marks are developed in a known manner, and the integral density thereof is used to control the process parameters. This principle is also known from U.S. Pat. No. 5,400,120, with the use of various toner marks.

The known toner marks are specifically constructed or, respectively, suited for regulating an individual process parameter. Various differently constructed toner marks are used for the regulation of the various parameters of the overall process.

SUMMARY OF THE INVENTION

An object of the present invention is to provide a method for optimizing the raster half-tone representation in electrophotographic printer and copier apparatuses, by setting the process parameters that influence the print image dependent on a raster toner mark, in which method all essential parameters that influence the print image are acquired by scanning the raster toner mark, so that it is possible, by means of purposive setting of a few parameters, to achieve an optimal half-tone reproduction with high resolution.

According to the invention, in a method for optimizing a half-tone representation by optimizing the toner deposition intensity in electrophotographic printer and copier apparatuses, this is achieved by the steps of: dependent on an optical density of a raster toner mark, determined integrally over the surface, a bias potential and/or a toner concentration are modified, whereby the toner mark consists of repetitions of macropixels, a macropixel is at least one dimension larger than the micropixel raster dimension, and is smaller than 0.5 mm, and the macropixel contains at least one micropixel that is not inked with toner, as well as at least one micropixel that is inked with toner.

The method for optimizing a half-tone representation in electrophotographic printer and copier apparatuses, may instead provide that a) basic values are adjusted, b) before and during a print or copy process, a raster toner mark is produced on a photoconductor, whereby the toner mark consists of repetitions of macropixels, a macropixel is at least one dimension larger than the micropixel raster dimension and is smaller than 0.5 mm, and the macropixel comprises at least one micropixel that is not inked with toner and at least one micropixel that is inked with toner, c) an optical density of the raster toner mark, measured integrally over the surface, is determined, d) a bias potential is lowered with respect to a current value if the optical value exceeds a target value and the bias potential is greater than a minimum value, e) the photoconductor is discharged, cleaned and charged again, and f) the steps b) to e) are subsequently repeated. Advantageous developments are provided by increasing the bias potential with respect to the current value if the optical density falls below a target value and is greater than a minimum value, and the bias potential is below a maximum value. Preferably, the bias potential remains unmodified if the optical density corresponds to the target value. The bias potential is lowered with respect to the current value, if the optical density exceeds a target value and is smaller than a maximum value, and the bias potential is greater than a minimum value. The toner concentration is increased if the optical density is smaller than the minimum value.

In one embodiment, during or shortly after the time of the increasing of the toner concentration the bias potential is lowered. The toner concentration is lowered if the optical density is greater than a maximum value. Additional comparison values are provided between the minimum value of the bias potential and the maximum value of the bias potential.

In the second method set forth above, instead of step d), in a step d1) the bias potential and the toner concentration are lowered with respect to the current value if the optical density is greater than a maximum value, and the bias potential is greater than a minimum value. Alternately, instead of step d), in a step d2) the bias potential is increased if the optical density falls below a target value and is greater than a minimum value, and the bias potential is smaller than a maximum value. In a further embodiment, instead of step d), in a step d3) the bias potential and the toner concentration are increased if the optical density is smaller than a minimum value and the bias potential is smaller than a maximum value. Yet further advantages are provided when, instead of step d), in a step d4) the toner concentration is lowered if the optical density is greater than a maximum value and the bias potential is less than or equal to a minimum value. Instead of step d), in a step d5) the toner concentration is increased if the optical density is less than a minimum value and the bias potential is greater than or equal to a maximum value.

In the inventive method, a raster toner mark with fine raster elements is produced on a photoconductor, and the integral optical density thereof, averaged over the surface, is calculated. Dependent on the optical density so calculated, a bias voltage is modified and/or a toner concentration is altered.

By modification of the bias voltage applied between the photoconductor and the developer station, the quantity of toner deposited at the corresponding locations can be influenced. If in printer apparatuses that operate according to the "discharged area development" (DAD method), i.e. in which the regions that were previously exposed are inked with toner, the bias voltage is for example increased, the quantity of toner attracted by the photoconductor is thus, increased. By means of suitable regulation of the bias voltage within predetermined limits, the quantity of toner deposited on the photoconductor in the development process, and thereby the optical density of a toner mark, can thus be influenced.

A further possibility for influencing the toner deposition intensity or, respectively, the optical density of a toner mark is by varying of the toner concentrations, i.e. of the mixing ratio of microtoner and carrier components. Dependent on the determined optical density, it is thus possible to increase the toner deposition intensity on a photoconductor, for example by adding microtoner to the two-component developer. However, here it is to be taken into account that the increasing of the toner concentration, compared with the modification of the bias voltage, is a slow process, because both components have to be mixed and brought into a corresponding triboelectric state of excitation. Here, increasing of the toner concentration has a longer-lasting influence on the toner deposition intensity.

Moreover, it is to be taken into account that the toner concentration can easily be increased by the addition of toner into the two-component developer, but a reduction of the toner concentration can be achieved only by a more expensive "printing out" process. Here, the "printing out" process refers to the execution of several printing or copying processes, whereby the images should be as strongly inked as possible in order to remove as quickly as possible the greatest possible quantity of toner from the two-component developer.

In the inventive method, the possibilities of modifying the bias voltage and the toner concentration are connected with one another, whereby a fluctuation of the toner deposition intensity or, respectively, of the optical density of a toner mark, and thereby the quality of a half-tone image, is held within extremely small limits. The inventive method thus has in particular the advantage that fluctuations of other parameters acting on the system are already compensated by the purposive modification of two parameters. These are hereby the process parameters described above, such as for example the producing charge of the photoconductor, its duration of use, the temperature and the cyclical loading of the photoconductor, as well as the air humidity.

According to a preferred embodiment of the invention, the bias voltage is for example increased as soon as the optical density of the toner mark has fallen below a target value. At the same time, however, the optical density of the toner mark may not have fallen below a minimum value, and the bias voltage must be located below a predetermined upper boundary value.

In addition, as soon as the optical density of the toner mark exceeds the target value and lies below an upper boundary value, the bias voltage is lowered. A lowering of the bias voltage is however carried out only if the bias voltage is greater than a predetermined lower boundary value.

If in the previously described method steps the optical density of the toner mark exceeds the upper boundary value, the toner concentration of the two-component developer is reduced by printing out toner. Correspondingly, the toner concentration is increased as soon as the optical density of the toner mark falls below a lower boundary value.

In a further preferred embodiment of the invention, at the time of the increase of the toner concentration, or shortly after this time, the current bias voltage is set to a target value in order to prevent the optical density from temporarily exceeding the upper boundary value due to the time-delaying effect of increasing the toner concentration.

Such an overshooting of the optical density can also be avoided by providing additional comparison values, for example between the minimum value of the bias potential and the maximum value of the bias potential.

According to the invention, neither the bias voltage nor the toner concentration is modified if the optical density of the toner mark corresponds precisely to the required target value.

BRIEF DESCRIPTION OF THE DRAWINGS

In the following the invention is explained in detail with reference to the attached drawings.

FIGS. 2*a* and 2*b* are flow diagrams; of a preferred embodiment of the inventive method, and FIG. 3 shows, as an example, an enlarged plan view of a raster toner mark for use in the inventive method.

DETAILED DESCRIPTIONS OF THE PREFERRED EMBODIMENTS

In the following, the inventive method is specified in principle on the basis of FIGS. 1*a* to 1*d*. FIGS. 1*a* to 1*d* show as an example a start of a regulation given excessively high toner concentration.

At a time $t_0$, the optical density OD has a maximum value $OD^{max}$. Since in the ideal case the optical density OD is to be lowered to a target value $OD_s$, and in the present example the toner deposition intensity on a photoconductor, and thus also the optical density OD of a toner mark, can be lowered by keeping the bias voltage $V_B$ as low as possible, in the present case the bias voltage $V_B$ has at the time $t_0$ a lower boundary value $V_B^{min}$.

Figure 1A:
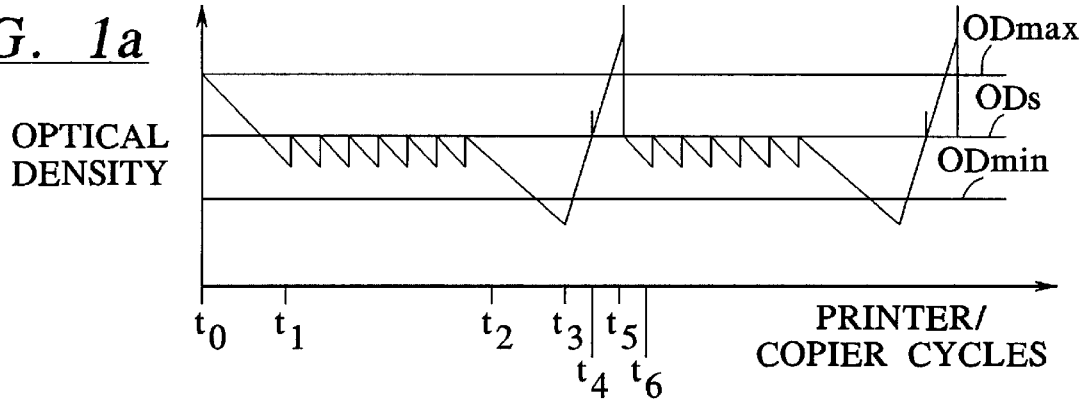
FIG. 1*a* is a graph which shows a curve of the optical density dependent on printer or copier cycles given the use of a preferred embodiment of the inventive method.
Figure 1B:
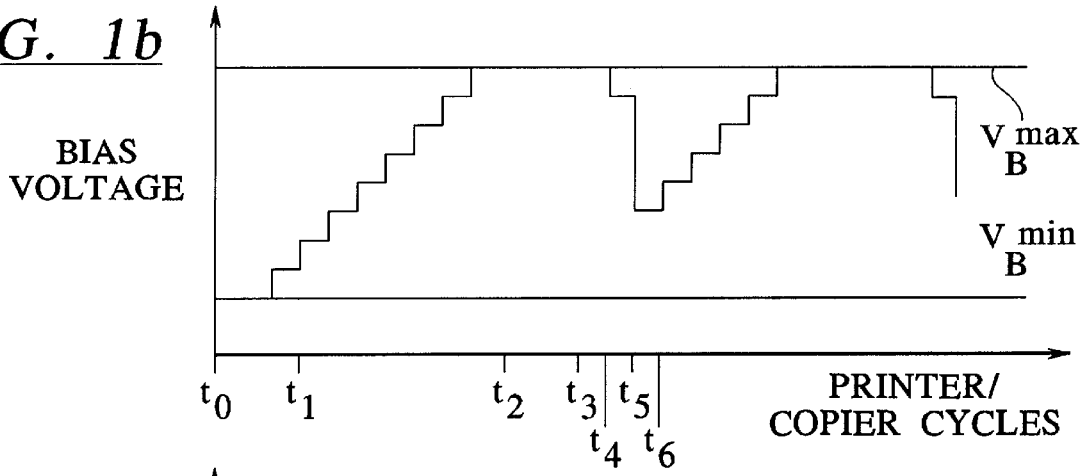
FIG. 1*b* is a graph which shows a curve of a bias voltage dependent on printer or copier cycles given the use of a preferred embodiment of the inventive method.
Figure 1C:
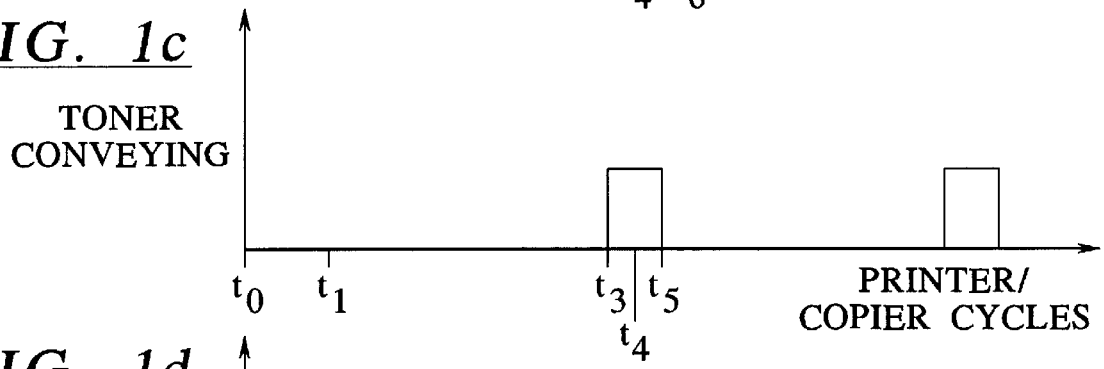
FIG. 1*c* is a graph which shows times of a toner conveying dependent on printer or copier cycles given the use of a preferred embodiment of the inventive method; shows a curve of the toner concentration dependent on printer or copier cycles given the use of a preferred embodiment of the inventive method.
Figure 1D:
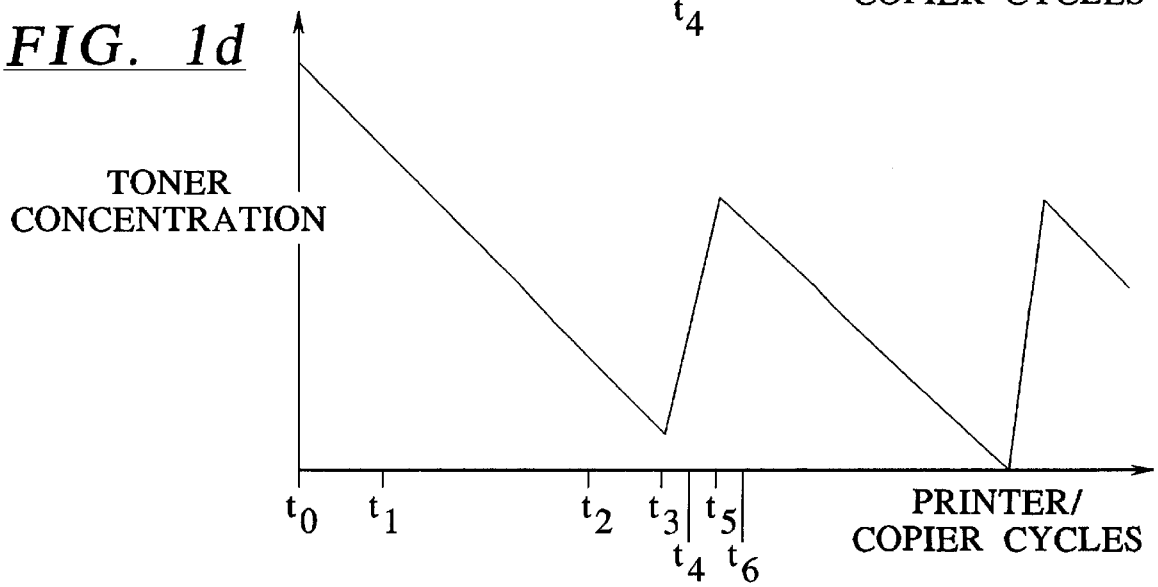

In FIG. 1*c*, toner conveying is shown dependent on printer or, respectively, copier cycles that are not carried out at time $t_0$, since, as can be learned from FIG. 1*a*, the optical density is greater than the target value $OD_s$. For clarification, in FIG. 1*d* the toner concentration in the two-component developer is likewise shown dependent on printer or, respectively, copier cycles.

One or more printer or, respectively, copier cycles are now carried out up to a time $t_1$ at a minimal bias voltage $V_B^{min}$ (as shown in FIG. 1*b*) without conveying of toner (as an indicated in FIG. 1*c*). By this means, the optical density OD decreases to a value below the target value of the optical density $OD_s$. The toner conveying step (shown in FIG. 1*c*) is not yet activated. Corresponding to the optical density OD, the toner concentration (FIG. 1*d*) also decreases.

Since at time $t_1$ the optical density OD is below the target value of the optical density $OD_s$, the bias voltage $V_B$ is raised by a step above the minimal value $V_b^{min}$ (see FIG. 1*b*), in order in this way to increase the toner deposition intensity on the photoconductor. As can be learned from FIGS. 1*a* and 1*b*, the bias voltage $V_B$ is respectively increased by a further voltage step as soon as the optical density OD of the toner mark has decreased below the target value of the optical density $OD_s$.

These steps are carried out up to a time $t_2$. Since at time $t_2$ the optical density OD of the toner mark is below the target value $OD_s$, but the bias voltage $V_B$ can no longer be increased since it has already achieved a maximum value $V_B^{max}$ (FIG. 1*b*), the bias voltage $V_B$ is maintained at the maximum value $V_B^{max}$.

If, for example at a time $t_3$, the optical density OD is below a predetermined minimal value of the optical density $OD^{min}$, the toner conveying step is activated, as can be learned from FIG. 1*c*. At time $t_3$, the bias voltage $V_B$ is further maintained at its maximum value $V_B^{max}$. As can be learned from FIG. 1*d*, the toner concentration increases beginning at time $t_3$.

Due to the increasing toner concentration, the optical density OD also increases (as shown in FIG. 1), and at a time $t_4$ it is already above the target value $OD_s$; the bias voltage $V_B$ (FIG. 1*b*) is thus again lowered.

Since the toner concentration increases (FIG. 1*a*) up to a time $t_5$ (the end of the toner conveying step), at time $t_5$ the optical density is above the maximum value $OD^{max}$. Such an overshooting could for example be counteracted by supplying a lower quantity of toner, by additional bias comparison voltages between the maximum and minimum bias voltage or by the automatic lowering of the bias voltage $V_B$ at or shortly after the time of the toner conveying step.

As can be learned from FIG. 1*b*, the bias voltage $V_B$ is lowered until the optical density OD falls below the target value $OD_s$. Corresponding to the time segment between $t_1$ and $t_2$, beginning at a time $t_6$ the bias voltage $V_B$ is increased or maintained dependent on the value of the optical density OD. Thus, beginning at the time $t_6$ the inventive method runs analogously to the above steps carried out beginning at time $t_1$.

Figure 2A:
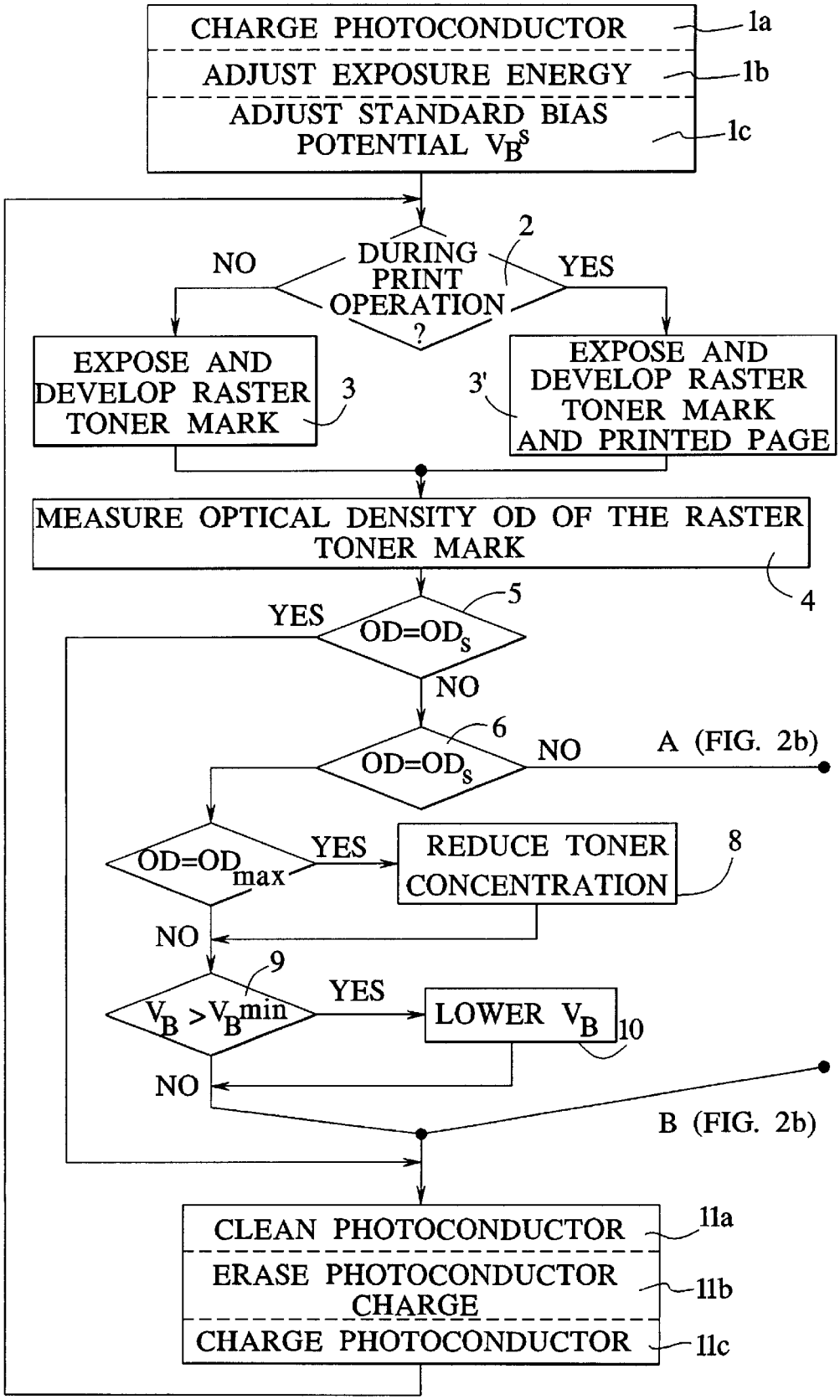

FIGS. 2*a* and 2*b* show a flow diagram of a preferred embodiment of the inventive method for optimizing toner deposition intensity in electrophotographic printer and copier means. In preparatory steps 1*a* to 1*c*, after the start of a printing operation the photoconductor is charged to a charge potential and is exposed exclusively with an adjusted or, respectively, regulated exposure energy, so that a discharge potential reaches a predetermined target value. In step 1*c*, the bias potential is adjusted to a standard value $V_B^s$.

In step 2, a query is made as to whether the printer or copier apparatus is in a print operation or not. If the printer or copier apparatus is still not in the print operation, but rather is for example still in a warm-up phase, a raster toner mark is exposed on the photoconductor and subsequently developed.

During the print operation, in addition to the raster toner mark a printed page is also exposed and developed on the photoconductor (in step 3').

In step 4, the optical density OD of the raster toner mark produced in step 3 or, respectively, 3' is measured. If the decision at step 5 is "yes," since the optical density OD of the raster toner mark corresponds to the sought target value $OD_s$, a further regulation of the toner deposition intensity or, respectively, of the optical density OD is not required, so that the steps 6 to 10 or, respectively, 6' to 10' are omitted and the steps 11*a* to 11*c* are carried out, in which the photoconductor is cleaned, the photoconductor charge is erased and the photoconductor is then again charged. Following steps 11*a* to 11*c*, a return is made to step 2 for the next print process.

If the decision made in step 5 is "no," i.e. the optical density OD of the raster toner mark does not correspond to the target value $OD_s$, in step 6 it is determined whether the optical density OD of the raster toner mark is greater than the target value $OD_s$ or not. If the target value $OD_s$ is greater, in step 7 it is investigated whether the optical density OD of the raster toner mark is greater than a maximal value $OD^{max}$ or not. If the optical density is greater than the maximum value $OD^{max}$, in step 8 the toner concentration is reduced, e.g. by printing out the toner.

If the optical density OD in step 7 is not greater than a maximum value $OD^{max}$, in step 9 it is determined whether the bias potential $V_B$ is greater than a minimum value $V_B^{min}$ or not. If the bias potential $V_B$ is greater than the minimum value $V_B^{min}$, for the reduction of the optical density OD or, respectively, of the toner deposition intensity, in step 10 the bias potential $V_B$ is lowered.

However, if the bias potential $V_B$ is not greater than a minimum value $V_B^{min}$, in the steps 11*a* to 11*c* are carried out, i.e. the photoconductor is cleaned, the photoconductor charge is erased and the photoconductor is subsequently charged again.

Following the steps 11*a* to 11*c*, a transition is again made to step 2.

If the decision in step 6 is "no," i.e. the optical density OD of the raster toner mark is not greater than the target value $OD_s$, in place of steps 7 to 10 the steps 7' to 10' are carried out.

In step 7' as shown in FIG. 26 it is determined whether the optical density OD is smaller than a minimum value $OD^{min}$ or not. If the optical density is smaller than the minimum value $OD^{min}$, in step 8' the toner concentration is increased by supplying toner to the two-component developer. If, however, the optical density OD is not smaller than the minimum value $OD^{min}$, in step 9' it is decided whether the bias potential $V_B$ is smaller than a maximum value $V_B^{max}$. If the decision is "yes," the bias potential $V_B$ is increased in step 10'.

If, however, the bias potential $V_B$ has already reached the predetermined maximum value $V_B^{max}$, the steps 11*a* to 11*c* are carried out, as described above. Following step 11*c*, the optimization method is likewise repeated after step 2.

FIG. 3 shows a plan representation of a raster toner mark, as used in an electrophotographic printer with a resolution of 600 dpi and an LED character generator.

The raster toner mark is constructed from micropixels MIP and macropixels MAP. A micropixel MIP with a edge length a (in this case, 42 $\mu$m) defines the smallest inkable spot that in the LED character generator used corresponds to the imaging of an individual LED light point on the photoconductor. The length a is also called a micropixel raster dimension. Several micropixels MIP form a macropixel MAP (1,1) (a basic cell). In the example shown, a macropixel MAP with an edge length b consists of 8×8=64 micropixels, i.e. the edge length b of the macropixel amounts to 8×42 $\mu$m=0.336 mm.

With the micropixels MIP a raster structure S is now shown in the macropixel MAP that corresponds to a fine gray value in the gray value scale (half-tone representation). This fine structure S is dimensioned in such a way that in the macropixel MAP (1,1) at least one arbitrary micropixel is not inked with toner.

Dependent on the development method used (whether reversal development or positive development), either the structure S is inked and the surrounding micropixels remain toner-free or vice versa. In the example as shown with reverse development, in which the charged photoconductor is discharged dependent on sign, the structure S remains toner-free.

Since in electrophotographic printing the electrical inking ratios are different in the direction of rotation of the photoconductor drum and transverse thereto, corresponding to the representation of FIG. 3 it is advantageous to form a line-shaped structure S in the macropixel MAP (1,1), with a defined expansion in the X direction (abscissa) and in the Y direction (ordinate). Given the construction of a raster toner mark, it is thereby possible to represent, from a multiplicity of macropixels MAP (1,1) to MAP (n,n), the macropixels e.g. MAP (1,1) and MAP (1,2) or, respectively, MAP (2,1), and thereby the structure S contained in the macropixels respectively rotated 180° to one another. There thus results a toner mark with a structure that is particularly sensitive in the X or Y direction.

In the preferred embodiment, the toner mark consists of 15×15 macropixels with an overall edge length 15×0.336 mm=5 mm, of which however only 4 macropixels are shown. The size of this toner mark is however arbitrary. It depends on the place of application and the type of scanning.

In place of a raster tone mark, constructed from quadratic macropixels, it is also possible to use a raster tone mark consisting of individual lines extending in the Y direction. The lines then have a width in the X direction corresponding to the width a of a micropixel, and an arbitrary length. A line macropixel then has a width b in the X direction and a length in the Y direction which can be a multiple of b.

In general, the following thus holds for a toner mark which is suitable for the optimization of half-tone images:

d. they consist of repetitions of macropixels (basic cells), e. a macropixel map is larger by at least one dimension than the micropixel raster dimension a (thus at least 2×a) and smaller than 0.5 mm, f. the pattern S contained in the macropixel is constructed in such a way that it comprises at least one micropixel that is not inked with toner and at least one micropixel that is inked with toner.

Although other modifications and changes may be suggested by those skilled in the art, it is the intention of the inventor to embody within the patent warranted hereon all changes and modifications as reasonably and properly come within the scope of their contribution to the art.

What is claimed is:

1. A method for optimizing half-tone representation in electrophotographic printer or copier apparatuses, comprising the steps of:

applying a raster toner mark on a surface., determining an optical density of said raster toner mark, determined integrally over a surface, modifying at least one of a bias potential applied to a photoconductor of the electrophotographic printer or copier apparatus and a toner concentration, said raster toner mark including repetitions of macropixels, said macropixels each being at least one dimension larger than a micropixel raster dimension, and being smaller than 0.5 mm, and said macropixels each including at least one micropixel that is not inked with toner, as well as at least one micropixel that is inked with toner.

2. A method according to claim 1, further comprising the step of:

increasing the bias potential with respect to a current bias potential value if the optical density falls below a target value and is greater than a minimum value, and the current bias potential is below a maximum value.

3. A method according to claim 1, further comprising the steps of:

maintaining the bias potential unmodified if the optical density corresponds to a target value.

4. A method according to claim 1, further comprising the step of:

lowering the bias potential with respect to a current bias potential value, if the optical density exceeds a target value and is smaller than a maximum value, and the current bias potential is greater than a minimum value.

5. A method according to claim 1, further comprising the step of:

increasing toner concentration if the optical density is smaller than the minimum value.

6. A method according to claim 5, further comprising the step of:

lowering the bias potential during or shortly after a time of the increasing of the toner concentration.

7. A method according to claim 1, further comprising the step of:

lowering the toner concentration if the optical density is greater than a maximum value.

8. A method according to claim 1, comprising the step of:

providing additional comparison values between the minimum value of the bias potential and the maximum value of the bias potential.

9. A method for optimizing a half-tone representation in electrophotographic printer or copier apparatuses, comprising the steps of a) adjusting basic values, b) before and during a print or copy process, producing a raster toner mark on a photoconductor, said raster toner mark includes repetitions of macropixels, each of said macropixels being at least one dimension larger than the micropixel raster dimension a and being smaller than 0.5 mm, and each of said macropixels having at least one micropixel that is not inked with toner and at least one micropixel that is inked with toner, c) determining an optical density of the raster toner mark, measured integrally over a surface, d) lowering a bias potential with respect to a current value of the bias potential if the optical value exceeds a target value and the bias potential is greater than a minimum value, e) discharging, cleaning and recharging the photoconductor, and f) repeating the steps b) to e).

10. A method according to claim 9, wherein said step d) also includes a substep of:

lowering toner concentration with respect to a current value if the optical density is greater than a maximum value.

11. A method according to claim 9, further comprising the step of:

increasing the bias potential if the optical density falls below a target value and is greater than a minimum value, and the bias potential is smaller than a maximum value.

12. A method according to claim 11, further comprising the step of:

increasing toner concentration if the optical density is smaller than a minimum value.

13. A method according to claim 9, further comprising the step of:

lowering toner concentration if the optical density is greater than a maximum value and the bias potential is less than or equal to a minimum value.

14. A method according to claim 9, further comprising the step of:

increasing toner concentration if the optical density is less than a minimum value and the bias potential is greater than or equal to a maximum value.

* * * * *